United States Patent [19]

Ueda et al.

[11] 4,329,965

[45] May 18, 1982

[54] DIESEL ENGINE EXHAUST GAS RECIRCULATION AND INTAKE AIR FLOW CONTROL SYSTEM

[75] Inventors: Tatehito Ueda, Susono; Kunihiko Hiyama, Chiryu, both of Japan

[73] Assignee: Toyota Jidosha Kogyo Kabushiki Kaisha, Toyota, Japan

[21] Appl. No.: 137,650

[22] Filed: Apr. 7, 1980

[30] Foreign Application Priority Data

Oct. 9, 1979 [JP] Japan ..... 54-130496

[51] Int. Cl.[3] ..... F02M 25/06

[52] U.S. Cl. ..... 123/569

[58] Field of Search ..... 123/569, 571, 568

[56] References Cited

U.S. PATENT DOCUMENTS 4,157,081 6/1979 Wake et al. ..... 123/569

4,237,837 12/1980 Toda et al. ..... 123/569

FOREIGN PATENT DOCUMENTS 2529208 2/1977 Fed. Rep. of Germany ..... 123/571

2750537 5/1979 Fed. Rep. of Germany ..... 123/569

*Primary Examiner*—Wendell E. Burns

*Attorney, Agent, or Firm*—Stevens, Davis, Miller & Mosher

[57] ABSTRACT

In a diesel engine which includes an air intake system, an exhaust system, and an exhaust gas recirculation passage which recirculates part of the exhaust gases produced by the engine from the exhaust system to the air intake system, a control system for the recirculation of exhaust gases and the flow of intake air, having an intake air flow control valve mounted in the air intake passage, and a recirculated exhaust gas flow control valve, mounted in the exhaust gas recirculation passage, these two control valves being so coupled together that, as one of them opens progressively, the other closes progressively, and vice versa, so that exhaust gas recirculation ratio alters in substantially direct proportion to the amount of opening of the exhaust gas recirculation flow control valve.

4 Claims, 4 Drawing Figures

DIESEL ENGINE EXHAUST GAS RECIRCULATION AND INTAKE AIR FLOW CONTROL SYSTEM

BACKGROUND OF THE INVENTION

The present invention is concerned with the field of exhaust gas recirculation in diesel engines, and, more particularly, is concerned with a system for control of intake air flow and exhaust gas recirculation flow for a diesel engine, in which the percentage of exhaust gas recirculation provided, in accordance with the operating condition of the engine, is made more nearly directly proportional to the amount of physical movement of a valve element in the system.

A diesel engine is usually operated in a so-called "excess air" mode, in which more air is sucked into the combustion chambers of the engine than is actually required for combustion of the fuel injected thereinto. Thus, according to this, exhaust gas recirculation in a diesel engine basically consists of replacing at least a part of this surplus air by recirculated exhaust gases, in order to improve the quality of the exhaust gases from the engine, and reduce the amount of harmful pollutants therein. Thus, an amount of exhaust gas recirculation should be performed which depends on the amount of surplus air inhaled during the current operating conditions of the engine.

Generally, the lower is the load on the diesel engine, the greater is the percentage of excess air inhaled; in other words, the higher the load on the engine, the less, proportionally, of the intake air is excess air. Also, the amount of excess air introduced into the combustion chambers of the engine decreases as the load on the engine increases. Therefore, in order to carry out exhaust gas recirculation with exhaust gas recirculation amount varying in response to the excess air amount, it is necessary to control the exhaust gas recirculation amount in such a way that the exhaust gas recirculation ratio (which is the amount of recirculated exhaust gases divided by the amount of recirculated exhaust gases plus the amount of inlet air) should decrease in response to an increase in engine load, and vice versa.

In practice, in order to control exhaust gas recirculation percentage, it is known, and practiced, to control the effective cross section of the exhaust gas recirculation passage, which leads a part of the exhaust gases from the exhaust system of the engine into the air intake passage thereof, by an exhaust gas recirculation flow control valve. The amount of flow of exhaust gas through said exhaust gas recirculation passage should be controlled depending on the amount of intake air flow, and, from the point of view of the control system, it is desirable that the percentage of exhaust gas recirculation should vary in approximately direct proportion to the degree of opening of the said exhaust gas recirculation flow control valve. However, in a diesel engine, the vacuum present in the intake passage of the engine, (i.e., the inlet manifold vacuum), is rather low, compared to that in a gasoline engine, especially when the load on the engine is in the low range. Thereby, when the diesel engine is operating in the low load condition, and a large amount of exhaust gas recirculation is required, although the exhaust gas recirculation flow control valve is opened wide, and the effective cross section of the exhaust gas recirculation passage is therefore large, nevertheless, because the inlet manifold suction is not high, the amount of exhaust gas recirculated through the exhaust gas recirculation passage is not increased sufficiently. For this reason, the percentage of exhaust gas recirculation does not alter even approximately in direct proportion to the amount of opening of the exhaust gas recirculation flow control valve, as would be desirable from the point of view of the control system. Thus, when the load on the diesel engine is low, it is difficult to obtain the necessary amount of exhaust gas recirculation.

SUMMARY OF THE INVENTION

The present invention takes its departure from the observation by the present inventors, during study of the subject of exhaust gas recirculation in diesel engines, that, in order for exhaust gas recirculation percentage to alter in direct proportion to the amount of opening of the exhaust gas recirculation flow control valve, the effective cross section of the air intake passage should be controlled, depending upon the amount of opening of the said exhaust gas recirculation flow control valve, whereby the ratio of intake air and recirculated exhaust gas could be more positively controlled.

Therefore, based upon the recognition of this concept, the present invention has as an object to provide an exhaust gas recirculation flow control system for a diesel engine in which the flow of intake air is also controlled in harmony with the control of the flow of recirculated exhaust gases.

It is a further object of the present invention to provide a control system for flow of recirculated exhaust gases and flow of intake air into a diesel engine, which can provide an approximately effectively directly proportional relationship between the amount of movement of a valve in the system, and the percentage of exhaust gas recirculation provided by the system, over a wide range of exhaust gas recirculation ratio.

According to this, the present invention provides, in a diesel engine comprising an air intake passage, an exhaust system, and an exhaust gas recirculation passage leading from the exhaust system to a point in the air intake passage; a system for control of flow of recirculated exhaust gases and flow of intake air, comprising: an intake air flow control valve, mounted in the air intake passage, which controls the flow resistance to air of the part of the air intake passage upstream of said point; and a recirculated exhaust gas flow control valve, mounted in the exhaust gas recirculation passage, which controls the flow resistance to exhaust gases of the exhaust gas recirculation passage; the operation of the intake air flow control valve and the recirculated exhaust gas flow control valve being so coupled together that, as the flow resistance of the one increases, that of the other decreases, and vice versa; the recirculated exhaust gas flow control valve substantially completely interrupting flow of recirculated exhaust gases, when the intake air flow control valve is at its operating condition wherein it provides minimum resistance to flow of air.

BRIEF DESCRIPTION OF THE DRAWINGS

The present invention will become more fully understood from the following description of some preferred embodiments thereof, which is to be taken in conjunction with the accompanying drawings. It should be clearly understood, however, that the description of the embodiments, and the drawings, are all of them provided purely for the purposes of illustration and exemplification only, and are in no way to be taken as limitative of the scope of the present invention. In the drawings.

DESCRIPTION OF THE PREFERRED EMBODIMENTS

Figure 1:
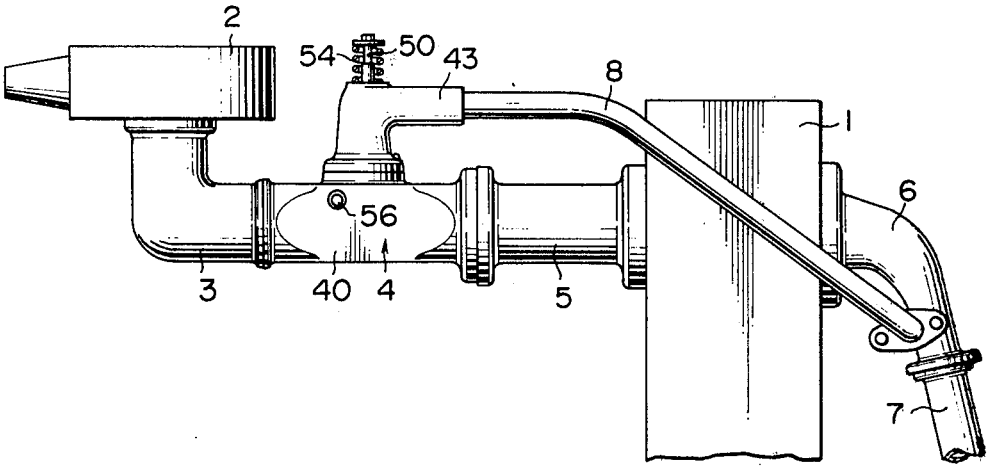
FIG. 1 is a somewhat schematic illustration, showing a diesel engine equipped with a flow control system which is a first embodiment of the present invention.

A first embodiment of the flow control system of the present invention, which controls intake air flow and also flow of recirculated exhaust gases, is shown in a somewhat schematic form in FIG. 1. In the figure, reference numeral 1 designates a diesel engine which sucks in air through, in order, an air cleaner 2, an intake duct 3, a valve system generally designated by 4, and an inlet manifold 5. Exhaust gases are vented from the diesel engine 1 through an exhaust manifold 6, which leads to an exhaust pipe 7. Part way along the exhaust manifold 6 there is connected an exhaust gas recirculation passage 8, which leads back to said valve system 4. Through this exhaust gas recirculation passage 8, part of the exhaust gases produced by the diesel engine 1 are recirculated, so as to be introduced into the intake system of the engine, through the valve system 4.

Figure 2:
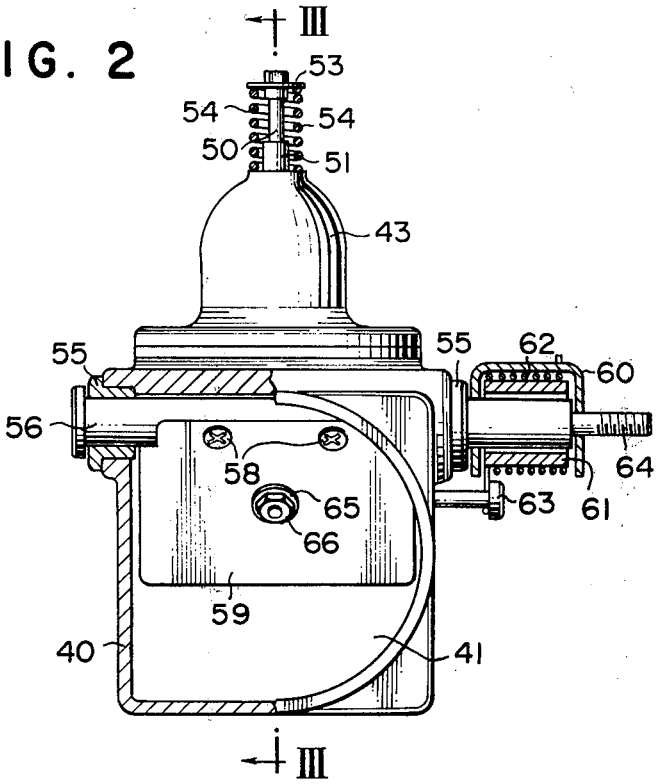
FIG. 2 is a part-sectional view across the intake passage of the engine shown in FIG. 1, showing some of the parts of the flow control device of the present invention in more detail.
Figure 3:
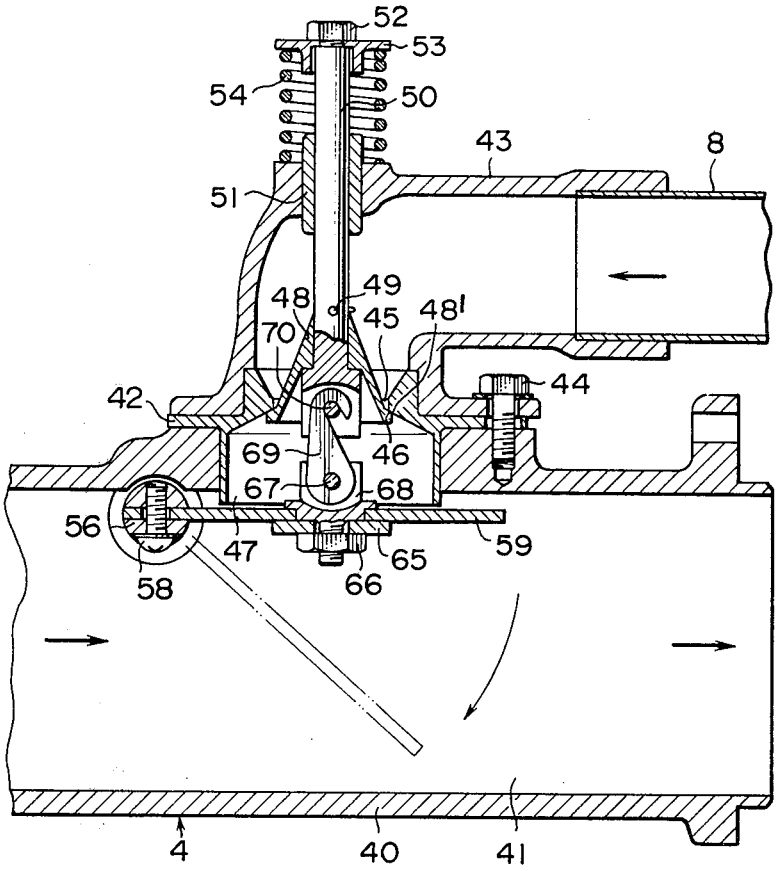
FIG. 3 is a cross sectional view, taken along the line III—III in FIG. 2, showing the intake air flow control valve and the recirculated exhaust gas flow control valve in detailed section.

FIGS. 2 and 3 show the detailed construction of the valve system 4. FIG. 2 is a cross sectional view across the direction of flow of intake air through the valve system 4, and FIG. 3 is a view taken in section along the line III—III in FIG. 2, the flow of intake air in this figure being from left to right. This valve system 4 comprises a housing 40, which defines within itself an inlet air passage 41, leading from the intake duct 3 to the intake manifold 5. In this first embodiment, as can be best seen from FIG. 2, this inlet air passage 41 is substantially rectangular in cross section, and the housing 40 is formed with circular end portions which meet and mate with the intake duct 3 and the intake manifold 5. On the upper side in the drawings of the housing 40 there is mounted a valve seat member 42, and on top of this there is mounted one end of an elbow member 43. The elbow member 43 is clamped to the housing 40 by a plurality of bolts 44 (only one is shown in the drawings), the valve seat member 42 being clamped between them. The other end of the elbow member 43, to the right in FIG. 3, is pressed onto the end of the exhaust gas recirculation passage 8, with an air- and gas-tight seal being formed therebetween.

The valve seat member 42 is formed with a conical valve seat 46 thereon, which defines a valve port 45. Further, the valve seat member 42 is formed with a projecting portion, which defines a recirculated exhaust gas inlet plenum 47 which opens from the valve port 45 into the inlet air passage 41.

The valve port 45 is controlled by a conical exhaust gas poppet valve member 48, which has a lower tapered portion 48', which, when the conical exhaust gas poppet valve member 48 is in the upward position as shown in FIG. 3, closely confronts and co-acts with the conical valve seat 46, so that by the meeting of these two surfaces the valve port 45 is completely closed. Said conical exhaust gas poppet valve member 48 is firmly attached by a pin 49 onto a valve shaft rod 50, which penetrates it in its axial direction. This valve shaft rod 50 passes through a bush 51, which is firmly set in said elbow member 43, and can be slid up and down through this bush 51. On the upper end in FIG. 3 of said valve shaft rod 50, in the atmosphere, outside the path of recirculated exhaust gases, there is attached a spring stopper 53, by a nut 52. A compression coil spring 54 is mounted between said stopper 53 and the outside of said elbow member 43, and this spring 54 biases the valve shaft rod 50 and the conical exhaust gas poppet valve member 48 upwards in the figures, thereby tending to close the valve port 45 by impelling the tapered portion 48' against the conical valve seat 46.

Two bushes 55 are mounted in the housing 40, as shown in FIG. 2. Through these bushes 55 there is mounted a flapper valve shaft rod 56, so as to be rotatable therein, and this flapper valve shaft rod 56 crosses, in this first embodiment, the upper part of the inlet air passage 41. To the flapper valve shaft rod 56 there is attached one edge of the flapper valve element 59, which in this embodiment is an approximately rectangular plate.

In FIG. 3 two positions of the flapper valve element 59 are shown. The position of this flapper valve element 59 wherein it almost closes the inlet air passage 41 is shown by phantom lines, and the position of this flapper valve element 59 wherein it provides very little or substantially no extra flow resistance to the inlet air passage 41 is shown by solid lines. From FIG. 2 it may be seen that one end of the flapper valve shaft rod 56 protrudes out from the housing 40 to one side, and on this part there is fixedly attached a holder member 60. A sleeve member 61 is fitted rotatably over the flapper valve shaft rod 56, and, over this sleeve member 61, between it and the holder member 60, there is fitted a torsion coil spring 62, one end of which bears against the holder member 60, while the other end bears against a pin 63 which is fitted into said housing 40. Thereby the flapper valve shaft rod 56 is biased in the clockwise direction in FIG. 3 by this torsion coil spring 62. It is so arranged that the biasing action of the torsion coil spring 62 is less than the biasing action of the compression coil spring 54.

The extreme end of the flapper valve shaft rod 56 is provided with a screw thread 64, and by this screw thread 64 the flapper valve shaft rod 56 is coupled to a suitable actuating system, not shown, which drives the valve system of the present invention according to the amount of exhaust gas recirculation required for the diesel engine. This actuating system may be of a per se well known sort, and is therefore not further described here.

As seen in FIG. 3, at a middle portion of the flapper valve element 59 there is attached, by a nut 66 and a washer 65, a stud member 68, which is fitted with a pin 67 on which is fitted one end of a hook member 69, so that the hook member 69 may be rotated with respect to the flapper valve element 59. The other end of this hook member 69 is hooked over a pin 70, which is fixedly set in the lower portion of the valve shaft rod 50, below the conical exhaust gas poppet valve member 48.

The system explained above operates as follows. As seen in FIG. 3, when the flapper valve element 59 is in its fully anticlockwise position, so that it offers substantially no extra resistance to flow of air through the inlet air passage 41, then the conical exhaust gas poppet valve member 48 is held in its uppermost position, via the valve shaft rod 50, by the biasing action of the compression coil spring 54, and thereby its tapered portion 48' is held tightly against the conical valve seat 46 of the valve seat member 42. Thereby the valve port 45 is tightly and positively held closed, and therefore exhaust gas recirculation is completely prevented. From this position, as the actuating system (which is not shown) twists the flapper valve shaft rod 56 clockwise in FIG. 3, so that with this movement the flapper valve element 59 is moved gradually clockwise, and so that, according to this element's angle of movement, the effective cross sectional area of the inlet air passage 41 is decreased, thereby this inlet air passage 41 offers progressively greater and greater resistance to air flow therethrough. Along with this clockwise movement of the flapper valve element 59, via the linkage incorporating the hook member 69, etc., the valve shaft rod 50 is pulled downwards, against the biasing action of the compression coil spring 54, and, according to this, the conical exhaust gas poppet valve member 48 is moved progressively downwards, and the tapered portion 48' is moved further and further away from contact with the conical valve seat 46 of the valve seat member 42, the valve port 54 thereby being progressively opened. Thereby exhaust gases start to pass from the exhaust gas recirculation passage 8 through the valve port 45 into the recirculated exhaust gas inlet plenum 47, and thence into the inlet air passage 41.

The effective cross sectional area of said valve port 45, which largely depends on the width of the circular slot between the tapered portion 48' and the conical valve seat 46, is thereby steadily increased, according to the clockwise movement in FIG. 3 of the flapper valve element 59. In other words, as the opening amount of the exhaust gas recirculation flow control valve increases, and thereby the resistance thereof to flow of recirculated exhaust gases decreases, in accordance therewith the opening amount provided by the flapper valve element 59 decreases, and thereby the resistance of the intake passage to the flow of intake air increases.

The exact performance of decrease of flow resistance of the exhaust gas recirculation control poppet valve system, composed of the valve seat element 42 and the conical exhaust gas poppet valve member 48, etc., can be varied by varying the exact shape of the conical exhaust gas poppet valve member 48, which need not be formed as an exact cone, but may be formed in any suitable shape. By tailoring this shape, it is possible to arrange the performance of the entire valve system so that the exhaust gas recirculation ratio is, effectively, approximately varied in direct proportion to the angle of turning of the flapper valve shaft rod 56 provided by the actuating system. By this approximately linear dependence obtained in this way, the control of exhaust gas recirculation can be performed more accurately and easily, and the functioning of a control system therefor may be remarkably simplified.

Particularly, when the actuating system is providing substantially no turning amount for the flapper valve element 59, so that this element is at the position shown in FIG. 3 by solid lines, thereby the biasing action of the compression coil spring 54 holds the conical exhaust gas poppet valve member 48 tightly upwards against the valve seat member 42, and thereby the valve port 45 is completely closed, so that exhaust gas recirculation is completely shut off, with substantially no leakage, and thereby the engine is enabled to operate at its maximum power, because of the absence of leakage of exhaust gases through the exhaust gas recirculation control port 45.

The above described first embodiment of the flow control system of the present invention is one in which the inlet air passage 41 has a rectangular cross section. For this reason, the flapper valve element 59 is constructed in a substantially rectangular shape, so that the effective cross section of the inlet air passage 41 is approximately directly proportional to the amount of turning provided by the actuating system to the flapper valve shaft rod 56. Thereby, as shown in FIG. 3, the shape of the conical exhaust gas poppet valve member 48 may be approximately that of a simple cone. However, by tailoring or altering the shape of the poppet valve member 48, it is possible to produce a suitable performance of control of recirculated exhaust gas flow amount, to adapt the performance of the exhaust gas recirculation flow control valve to an intake air flow control valve which is made in a circular or elliptical shape.

Figure 4:
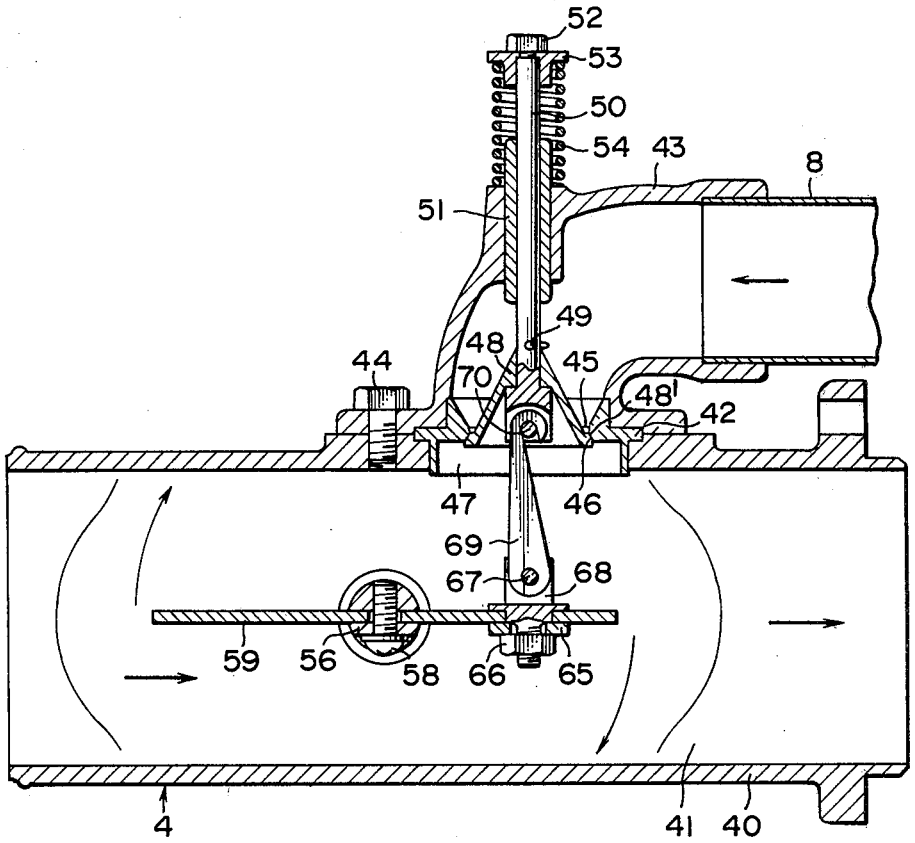
FIG. 4 is a view similar to FIG. 3, showing the construction of a second embodiment of the flow control device according to the present invention, which uses a butterfly type intake air flow control valve, instead of the flapper type intake air flow control valve of the first embodiment.

FIG. 4 shows a second embodiment of the present invention. In FIG. 4, parts which have the same structures and functions as parts in FIGS. 1, 2, and 3 are designated by the same reference numerals as in those figures. In this second embodiment the flapper valve element 59 in the first embodiment is replaced by a butterfly valve element 59. In this case, the cross section of the intake air passage 4 may be circular or oval. Since the rest of this embodiment is effectively the same as the first embodiment, further detailed explanation of the operation of this embodiment will be omitted, for the sake of brevity of description.

The two embodiments that have been described of the present invention show the intake air flow control valve as directly linked to the recirculated exhaust gas flow control valve by a mechanical linkage. Although this construction is preferred, it is not essential to the basic concept of the present invention, which is that these two valves should be coupled together in some fashion which provides for their mutually opposed operation, so that, as one of them opens smoothly, the other closes smoothly. It would be quite within the scope of the present invention for the coupling between these two valves to be embodied hydraulically or electrically. Therefore, although the present invention has been shown and described in terms of some preferred embodiments thereof, and in language more or less specific with regard to structural features thereof, and with reference to the illustrative drawings, it should be understood that in any particular embodiment of the present invention various changes, modifications, and omissions of the form and the detail thereof can be made by a person skilled in the art, without departing from the essential scope of the present invention.

We claim:

1. In a diesel engine, comprising an air intake passage, an exhaust system, and an exhaust gas recirculation passage leading from the exhaust system to a point in the air intake passage;

a system for control of flow of recirculated exhaust gases and flow of intake air, comprising:

an intake air flow control valve, mounted in the air intake passage, comprising a plate valve element rotatable around an axis arranged to traverse the air intake passage and which controls the flow resistance to air of the part of the air intake passage upstream of said point;

a recirculated exhaust gas flow control valve, mounted in the exhaust gas recirculation passage, which comprises a circular valve seat which defines a valve and a conical poppet valve element which engages into said circular valve seat so as to variably throttle said valve port and controls the flow resistance to exhaust gases of the exhaust gas recirculation passage;

and a link mechanism which operatively connects said recirculated exhaust gas flow control valve only with said intake air flow control valve so that, as the flow resistance of the one increases, that of the other decreases, and vice versa;

the recirculated exhaust gas flow control valve substantially completely interrupting flow of recirculated exhaust gases, when the intake air flow control valve is at its operating condition wherein it provides a minimum resistance to flow of air.

2. A flow control system according to claim 1, further comprising a first spring which biases said poppet valve element toward a position where it substantially completely closes said valve port, and a second spring which biases said plate valve element toward a position where it gives maximum resistance to flow of air, said first spring being strong enough to overcome said second spring.

3. A flow control system according to claim 2, wherein said link mechanism includes a first pin mounted to said plate valve element, a second pin mounted to said poppet valve element and a hook member having a root end pivotally mounted to one of said first and second pins and a hooked end engaged with the other of said first and second pins.

4. A flow control system according to claims 1, 2 or 3, wherein said intake air flow control valve further comprises a valve shaft adapted to be rotationally driven by an external actuating system.

* * * * *